US007017546B1

(12) United States Patent
Patel et al.

(10) Patent No.: US 7,017,546 B1
(45) Date of Patent: Mar. 28, 2006

(54) DRY SUMP OIL TANK ASSEMBLY

(75) Inventors: Dipak R. Patel, Grand Blanc, MI (US); Daniel J. Hommes, Shelby Township, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/975,891

(22) Filed: Oct. 28, 2004

(51) Int. Cl.
*F01M 1/16* (2006.01)
*F01M 13/00* (2006.01)

(52) U.S. Cl. ..... 123/196 R; 123/90.12; 123/198 C; 184/6.13

(58) Field of Classification Search ..... 123/90.12, 123/90.13, 41.42, 195 R, 195 C, 196 R, 123/198 C, 446; 184/6.13, 104.2, 104.3
See application file for complete search history.

(56) References Cited

U.S. PATENT DOCUMENTS 5,031,580 A * 7/1991 Takagi et al. ..... 123/196 R
5,558,549 A * 9/1996 Nakase et al. ..... 440/88 L
6,132,268 A * 10/2000 Uchino et al. ..... 440/38
6,655,307 B1 * 12/2003 Gokan ..... 114/55.5
6,786,188 B1 * 9/2004 Kawamoto ..... 123/196 R
6,823,829 B1 * 11/2004 Kawamoto et al. ..... 123/196 R
6,824,436 B1 * 11/2004 Matsuda ..... 440/88 A
6,889,651 B1 * 5/2005 Tanaka et al. ..... 123/196 R
2004/0084250 A1 * 5/2004 Morii et al. ..... 184/106
2004/0244761 A1 * 12/2004 Takeuchi ..... 123/196 R

FOREIGN PATENT DOCUMENTS

EP 001081343 A1 * 3/2001
JP 11-81972 A * 3/1999

* cited by examiner

*Primary Examiner*—Willis R. Wolfe, Jr.
(74) *Attorney, Agent, or Firm*—Christopher DeVries

(57) ABSTRACT

A tank assembly for a dry sump lubrication system for an internal combustion engine is disclosed. The tank assembly includes a tank having an upper tank portion and a lower tank portion. An interface assembly is disposed at the lower tank portion and is configured to operably deliver and receive a lubricant to and from the engine. A first end of a return tube in fluid communication with a second end is configured to receive lubricant from the engine at the interface assembly. The second end opposite the first end is in fluid communication with the upper tank portion. In this manner, a return hose and a feed hose may be connected to a same portion of the tank assembly.

26 Claims, 6 Drawing Sheets

DRY SUMP OIL TANK ASSEMBLY

BACKGROUND

The present disclosure relates generally to a lubrication system for an internal combustion engine and, more particularly, to a dry sump lubrication system including an oil tank located outside of the engine crankcase.

Most production cars have a wet sump lubrication system, where the sump is an area below a crankshaft of the engine. In a "wet" sump, the lubricant such as oil is stored beneath the crankshaft in an oil pan. Typically, the oil pan needs to be large and deep enough to hold about four to six quarts of oil.

In a dry sump lubrication system, extra oil is stored in a tank outside the engine rather than in the oil pan. Because a dry sump does not need a large and deep oil pan to hold the oil under the engine, the main mass of the engine can be placed lower in the vehicle.

Dry sump lubrication systems are commonly used with high performance engines such as engines used in motorcycles, high end performance vehicles, racing vehicles, and aircraft. Dry sump lubrication systems include a supply of lubricating oil retained in a reservoir or oil tank separate from a sump portion of the crankcase. During operation of the engine, oil is pumped from the oil tank and is directed to bearings and other parts of the engine which are to be lubricated. Oil that is thrown from the crankshaft and bearings during the operation of the engine is received in the sump located in a lower part of the crankcase. The oil received in the sump is pumped back to the oil tank by a scavenge pump. However, the lubricating oil which is pumped from the sump contains a large quantity of air, which has been absorbed into the oil due to splashing of the oil during the lubricating process. Air is also absorbed into the oil as the oil is pumped from the sump by the scavenge pump. Absorbed air in the lubricating oil results in lowered lubricating efficiency of the oil. Some prior art dry sump lubricating systems have used castor oil as a lubricant, since the foaming property of castor oil is superior to that of mineral oil.

More commonly, a deaerator or air separator is used for deaerating the oil after it is pumped from the engine sump by the scavenge pump and before the oil is returned to the engine. The deaerator may include a cylindrical tank mounted in an upper tank portion of the oil tank in which the oil is sprayed tangentially against the inside surface of a cylindrical wall defining the cylindrical tank. Some of the entrained air is thereby separated from the oil by centrifugal force due to the rotating movement of the oil during passage of the oil along the inside surface of the cylindrical wall from an inlet to an outlet of the deaerator. Another type of air separator includes an internal baffle assembly disposed in the upper tank portion of the oil tank.

In either of the above arrangements, a feed hose from the oil tank assembly is routed to the bottom of the oil tank assembly where deaerated oil collects, while a return hose from the scavenge pump is routed to the top of the oil tank assembly where the deaerator is located.

BRIEF SUMMARY

Disclosed herein is a tank assembly for a dry sump lubrication system for an internal combustion engine. The tank assembly includes a tank having a first tank portion and a second tank portion vertically arranged with respect to one another with an interface assembly disposed at the first tank portion. The interface assembly is configured to operably deliver and receive a lubricant to and from the engine. The tank assembly further includes a return tube having a first end in fluid communication with an opposite second end. The first end is in fluid communication with the lubricant from the engine via the interface assembly and the second end is in fluid communication with the second tank portion.

Also disclosed is a method for connecting a return hose and a feed hose to a same end of a tank assembly for a dry sump lubrication system for an internal combustion engine. The method includes configuring a tank having a first tank portion and a second tank portion; disposing an interface assembly at the first tank portion configured to operably deliver and receive a lubricant to and from the engine; and configuring a return tube having a first end in fluid communication with an opposite second end. The first end is configured to receive the lubricant from the engine at the interface assembly and the second end is in fluid communication with the second tank portion.

The above-described and other features are exemplified by the following figures and detailed description.

BRIEF DESCRIPTION OF THE DRAWINGS

Referring now to the figures, which are meant to be exemplary embodiments, and wherein like elements are numbered alike.

DETAILED DESCRIPTION OF THE PREFERRED EMBODIMENT

The present disclosure provides an assembly for a return hose from a scavenge pump to be connected at a fitting located on a bottom portion of an oil tank assembly having an integral return tube configured to return oil to a top portion of the oil tank assembly, thus allowing both return and feed hose connections to be made at the bottom portion of the oil tank assembly. This allows the two hoses necessary to circulate oil to and from the oil tank assembly to be run parallel to each other low in the underhood environment. In one embodiment, this allows the two hoses to be routed underneath an exhaust system and next to a front suspension of a vehicle.

Figure 1:
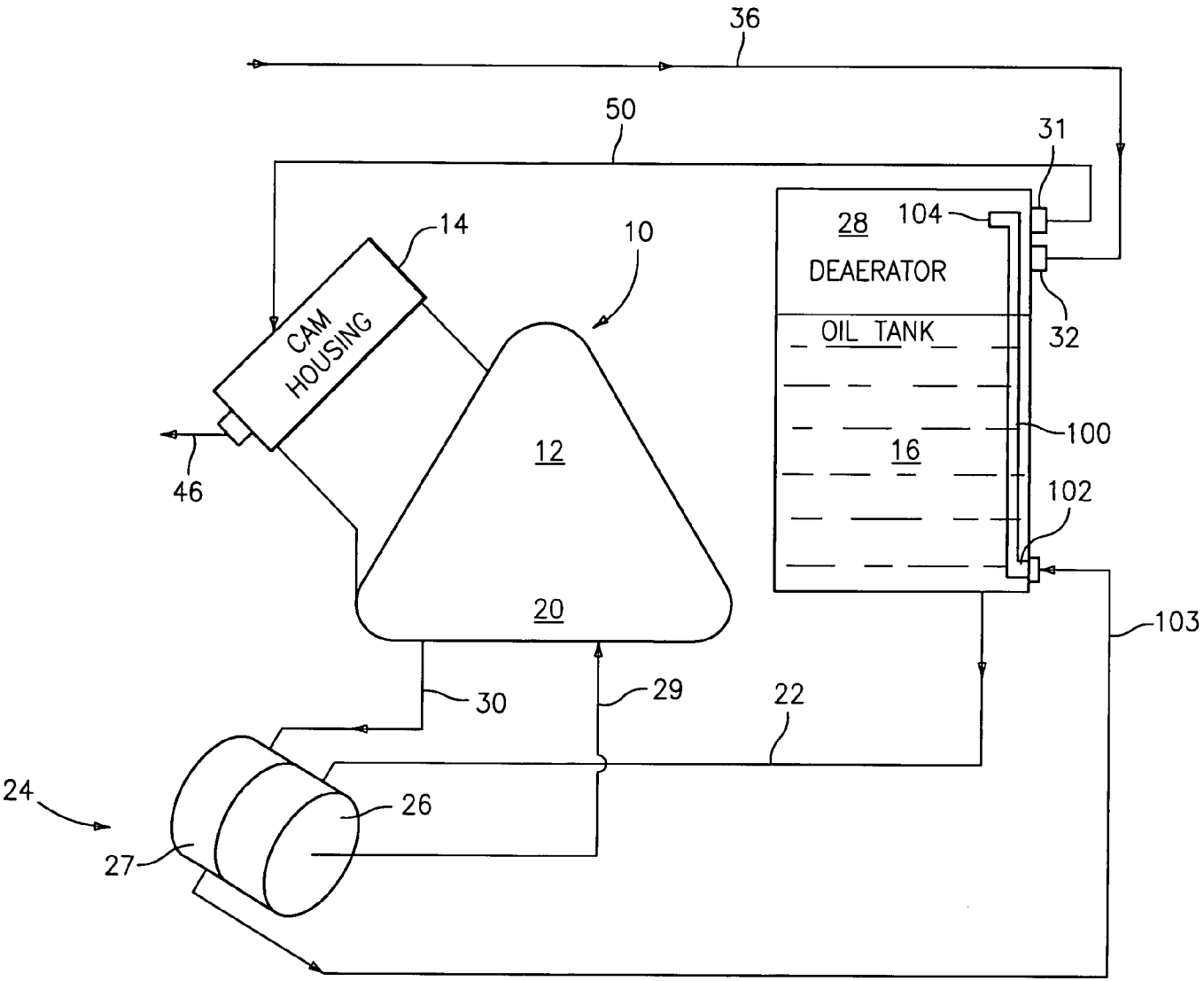
FIG. 1 is a schematic diagram of a dry sump lubrication system having an oil tank assembly with an integral return tube fitted to the bottom of the oil tank assembly and extending to a top thereof in accordance with an exemplary embodiment.

Referring now to FIG. 1, an engine 10 having a crankcase 12 includes a sump 20 in a lower portion thereof. Engine 10 includes, but is not limited to, an internal combustion engine, such as a motorcycle engine, high performance engine, racing engine or an aircraft engine which operates at relatively high revolutions per minute (RPMs) or experiences high lateral gravitational forces. Engine 10 also includes a cam housing 14 and an oil tank assembly 16 located externally of crankcase 12. Oil tank assembly 16 is configured having sufficient capacity to contain a quantity of oil to be supplied to crankcase 12 for continuous lubrication of the engine.

Oil tank assembly 16 is connected to crankcase 12 by means of a breather conduit 50 whereby oil tank assembly 16 and engine 10 can operate at the same operating pressure. Oil tank assembly 16 is connected by a conduit 22 to a pressure pump section 26 of a pump assembly 24. Pump assembly 24 comprises a pressure pump section 26 and a scavenge pump section 27. It will be recognized, however, that pump sections 26 and 27 may be separate or isolated pump assemblies. Oil is fed to engine 10 from pressure pump 26 by way of conduit 29. Oil, including entrained air, is fed to scavenge pump section 27 by means of conduit 30. Scavenge pump section 27 supplies oil to a deaerator or air separator 28 operably connected to an upper tank portion of oil tank assembly 16 via an integral return tube 100. Integral return tube 100 includes a first end 102 extending to a bottom portion of the oil tank assembly 16 to receive aerated oil from scavenge pump 27 via a return conduit or return hose 103. Integral return tube 100 includes a second end 104, opposite first end 102, extending to a top portion of the oil tank assembly 16 to provide aerated oil to air separator 28. Air separator 28 in turn allows the deaerated or separated oil to flow back and collect at a bottom portion of oil tank assembly 16 in fluid communication with pressure pump section 26 via conduit 22. Air separator 28 is provided with inlet and outlet 31 and 32, respectively, for pressure relief and separated air, respectively.

Make up fresh air flows in through inlet 32 via a conduit 36 to equalize crankcase pressure after evacuated gases are burned in the engine 10. It should be understood that the connection between outlet 31 and engine 10 may be made at any convenient location on engine 10. In the illustrated embodiment, the connection is made on cam housing 14. A conduit 50 allows tank 16 to operate at the same internal pressure as crankcase 12. Crankcase gases are evacuated from crankcase 12 and burned in the combustion chamber of engine 10 through outlet 46.

Figure 2:
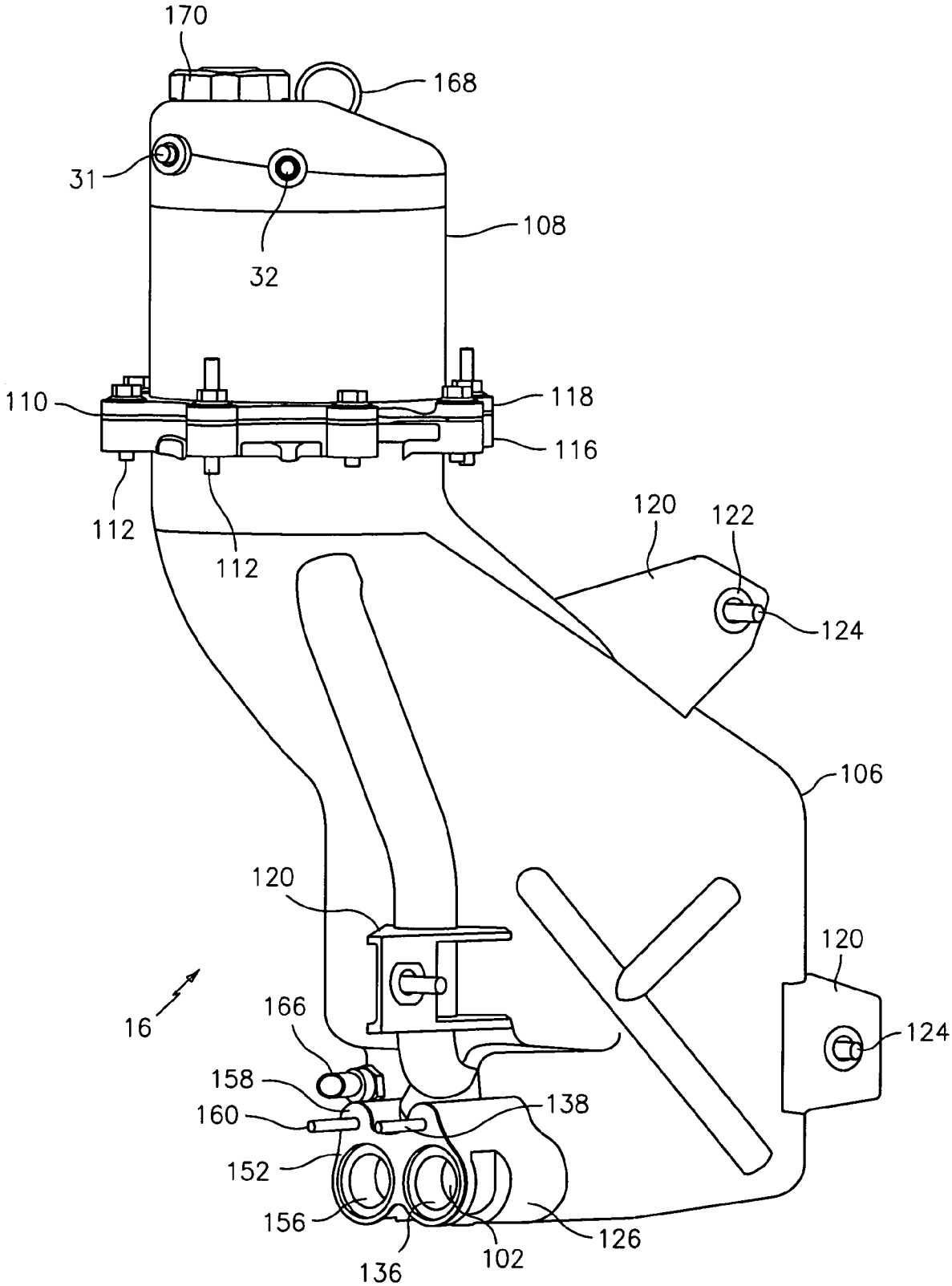
FIG. 2 is a perspective view illustrating the oil tank assembly for use with the dry sump lubrication system having a return hose from a scavenge pump of FIG. 1 connected to the integral return tube leading to the top of the oil tank assembly via a bottom fitting at the bottom of the oil tank assembly in accordance with an exemplary embodiment.

Referring now to FIG. 2, oil tank assembly 16 is described in more detail. Oil tank assembly 16 includes a lower tank 106 operably connected to an upper tank 108 with a gasket 110 therebetween. Lower and upper tanks 106, 108 are joined together with a plurality of mechanical fasteners 112 (e.g., threaded bolts) circumferentially disposed through corresponding openings in mating flanges 116 and 118 extending from joining ends of lower and upper tanks 106, 108, respectively. When the mechanical fasteners 112 are tightened, lower and upper tanks 106, 108 form a fluid tight seal to retain oil in a cavity defined by lower and upper tanks 106, 108.

Lower tank 106 includes a plurality of mounting flanges 120 extending therefrom (three shown in FIG. 2) for mounting tank assembly 16 to a vehicle. Each mounting flange 120 includes an aperture 122 for receiving a corresponding mechanical fastener 124 therethrough that is in turn fastened to the vehicle.

Lower tank 106 includes an interface assembly 126 disposed at a bottom portion thereof. Interface assembly 126 is configured to operably deliver and receive lubricant, such as oil, to and from the engine, as well as, to and from oil tank assembly 16. In an exemplary embodiment, interface assembly 126 includes, but is not limited to, an integral fitting assembly 126 extending from lower tank 106 configured to receive feed hose 128 extending to pressure pump 26 and return hose 103 extending from scavenge pump 27, as best seen with reference to FIGS. 1 and 3. It will be noted that feed hose 128 is depicted as conduit 22 in FIG. 1. It is contemplated that first end 102 of return tube 100 may optionally extend to scavenge pump 27, thus eliminating a separate return hose 103.

Figure 3:
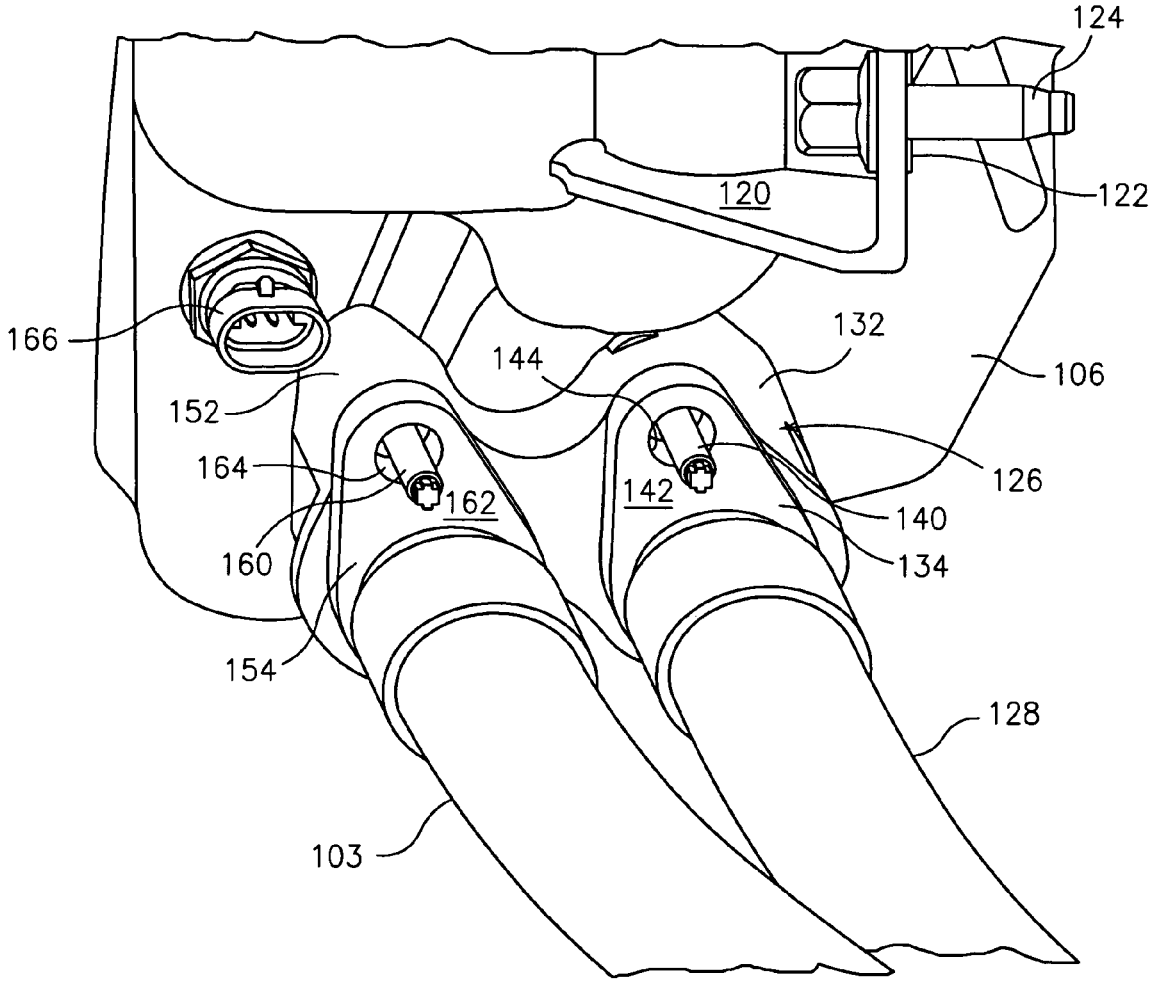
FIG. 3 is an enlarged partial view of a lower tank of the oil tank assembly of FIG. 2 illustrating a feed hose and a return hose extending from a fitting assembly on the lower tank in accordance with an exemplary embodiment.

Fitting assembly 126 includes a first fitting 132 configured to receive feed hose 128 via a first coupling 134 extending from feed hose 128 with specific reference to FIG. 3. First fitting 132 includes a tube 136 (FIG. 2) aligned with feed hose 128 in fluid communication with lower tank 106 to allow oil therein to be pumped out to engine 10 via pressure pump 26. First fitting 132 also includes a hole 138 having a threaded stud 140 extending therefrom. Stud 140 may be bonded within hole 138, or hole 138 may be threaded to threadably receive stud 140. First coupling 134 includes a first plate 142 abutting a mating surface of first fitting 132. First plate 142 includes an aperture 144 aligned with hole 138 and stud 140 extending therethrough to receive a nut (not shown) to sealingly fasten first plate 142 with first fitting 132.

Still referring to FIG. 3, fitting assembly 126 further includes a second fitting 152 configured to receive return hose 103 via a second coupling 154 extending from return hose 103. Second fitting 152 is integral with first end 102 of return tube 100 which is aligned with return hose 103 and in fluid communication with upper tank 108 via second end 104 of return tube 100 to allow oil from scavenge pump 27 to be pumped to air separator 28 disposed in upper tank 108. Second fitting 152 also includes a hole 158 having a threaded stud 160 extending therefrom (see also FIGS. 2 and 6). Stud 160 may be bonded within hole 158, or hole 158 may be threaded to threadably receive stud 160. Second coupling 154 includes a second plate 162 abutting a mating surface of second fitting 162. Second plate 162 includes an aperture 164 aligned with hole 158 and stud 160 extending therethrough to receive a nut (not shown) to sealingly fasten second plate 162 with second fitting 152. It will be recognized by one skilled in the pertinent art that fitting assembly 126 allows both feed and return hoses 128 and 103 to be run parallel with each other and allow connection at the same end of oil tank assembly 16 (e.g., a bottom portion). Furthermore, although first and second fittings 132 and 152, respectively, have been described as an integral assembly 126 extending from lower tank 106, fitting assembly 126 optionally includes fittings 132 and 152 that may be isolated and need not necessarily extend from lower tank 106. For example, fittings 132 and 152 may be disposed on opposite sides of a bottom portion of lower tank 106. Moreover, it is envisioned that fittings 132 and 152 are optionally merely interfaces with lower tank 106 to deliver and receive oil to and from engine 10 and lower tank 106. For instance, fitting 152 is optionally an interface where first end 102 extends from lower tank 106 or where an external return hose 103 is operably coupled to first end 102 of return tube 100.

Lower tank 106 optionally includes an oil temperature sensor connector 166 extending therefrom operably connected to an oil temperature sensor (not shown) disposed within lower tank 106. The oil temperature sensor is configured to signal an oil temperature within lower tank 106. It will also be noted that the sensor may be an oil level sensor configured to signal a low level condition when the oil level within lower tank 106 is not sufficient.

Referring again to FIG. 2, a dipstick 168 is illustrated extending from upper tank 108. Dipstick 168 is optionally included in conjunction with or in substitution of an oil level sensor to determine an amount of oil within lower tank 106. Upper tank 108 further includes an oil filler cap 170 for access to fill oil tank assembly 16 with a lubrication material such as oil, for example, including additives thereto known in the art.

Figure 5:
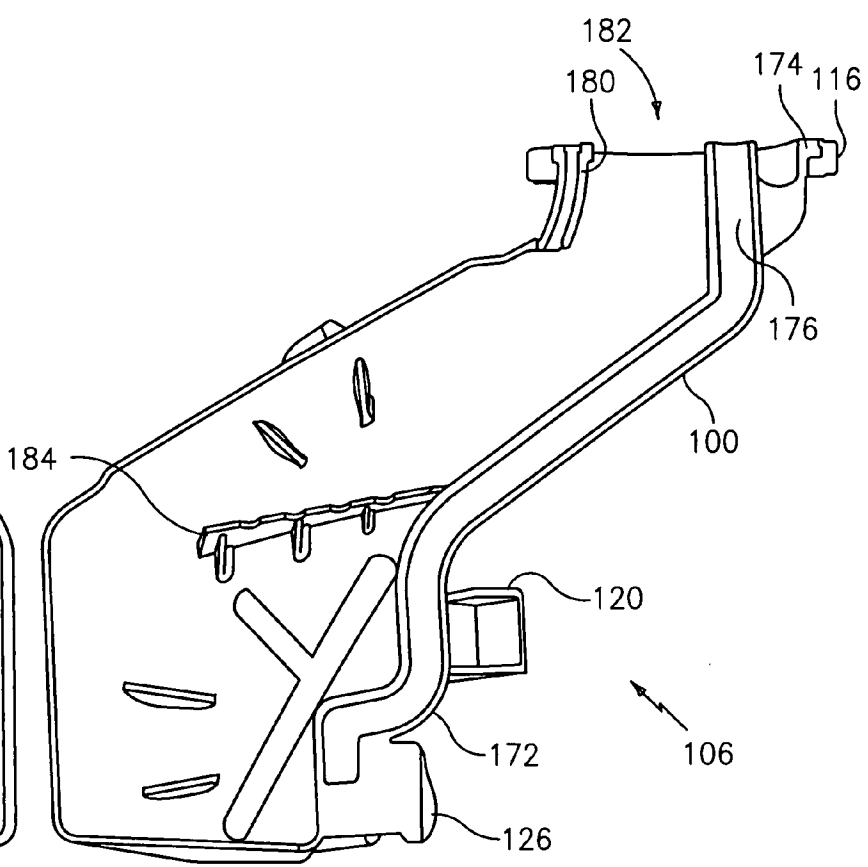
FIG. 5 is a cross-section view of the other half of the lower tank of the oil tank assembly of FIG. 2 in accordance with an exemplary embodiment.
Figure 4:
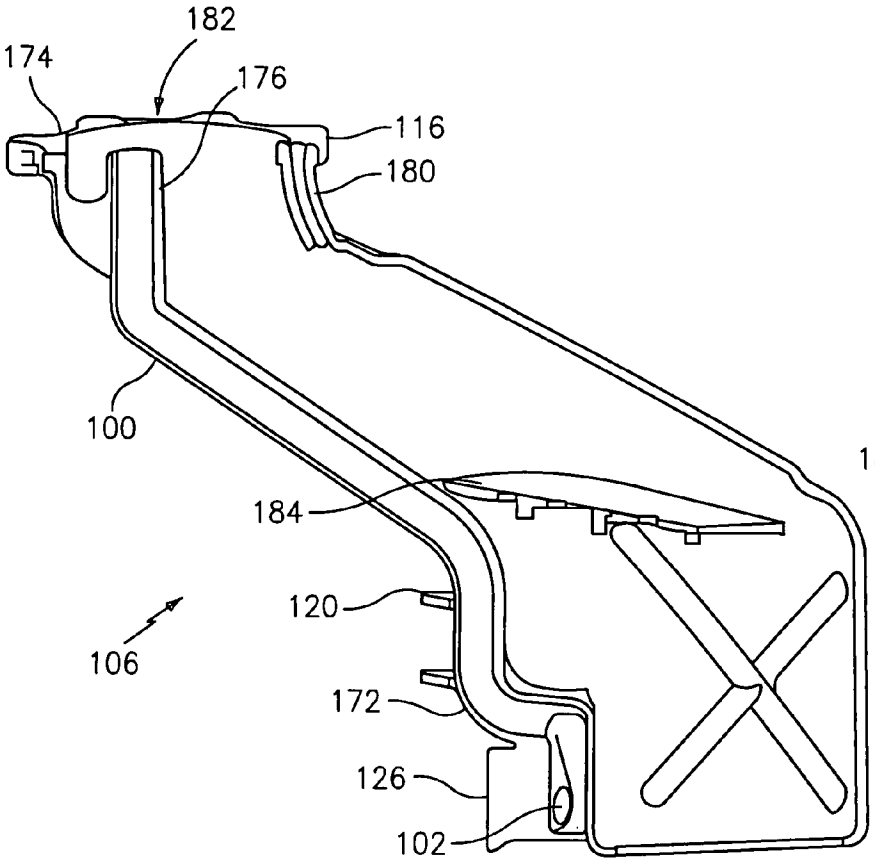
FIG. 4 is a cross-section view of one half of the lower tank of the oil tank assembly of FIG. 2 in accordance with an exemplary embodiment.
Figure 6:
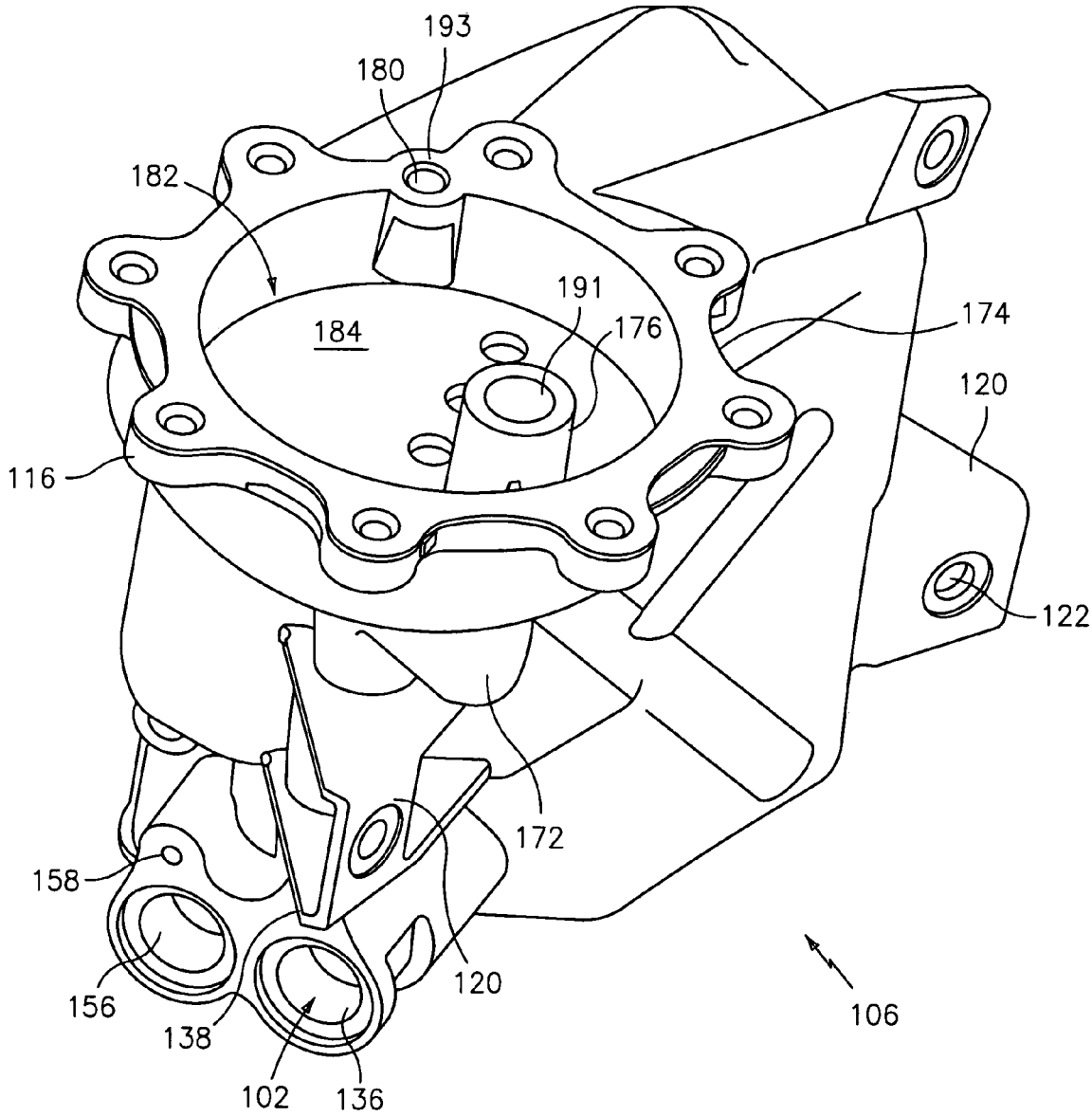
FIG. 6 is a perspective view of the lower tank of the oil tank assembly of FIG. 2 illustrating an opening thereto and the integral return tube within the opening in accordance with an exemplary embodiment.

Referring now to FIGS. 4–6, lower tank 106 will be described more fully. FIGS. 4–6 illustrate that return tube 100 is cast into lower tank 106. In particular, first end 102 is integral with fitting assembly 126 and tube 100 extending from first end 102 is cast as an external tube or channel 172 along a substantial length defining a length of lower tank 106. As external tube 172 extends toward a gasket surface 174 on mating flange 116 defining an opposite end of lower tank 106, external tube 172 transitions to an internal tube 176. An upper portion of lower tank 106 is further configured with a dipstick tube 180 cast therewith and internal to lower tank 106 to receive dipstick 168.

Deaerated oil from upper tank 108 flows through opening 182 into lower tank 106 and flows down to a bottom of lower tank 106. When deaerated oil exits upper tank 108 through opening 182, oil falls to a baffle 184 disposed in an intermediate portion of lower tank 106. Baffle 184 is configured to prevent oil from flowing into the upper part of the tank assembly 16 and away from the oil pick up opening (e.g., tube 136 leading to feed hose 128) during high lateral g-force maneuvers. Although lower tank 106 is illustrated as an offset lower tank 106 in the Figures, where an upper portion of lower tank 106 is offset from a lower portion thereof, it will be recognized by one skilled in the pertinent art that upper and lower portions defining lower tank 106 may be aligned with one another. In addition, it will be noted then that lower tank 106 may also be aligned with upper tank 108. Furthermore, although return tube 100 has been described as being integrally cast with lower and upper tanks, 106 and 108, respectively, it will be recognized by one skilled in the pertinent art that lower and upper tank portions along with return tube 100 may be formed and associated with each other in any other suitable manner. In either case, return tube 100 provides connection of feed and return hoses at one end of the oil tank assembly 16.

Figure 8:
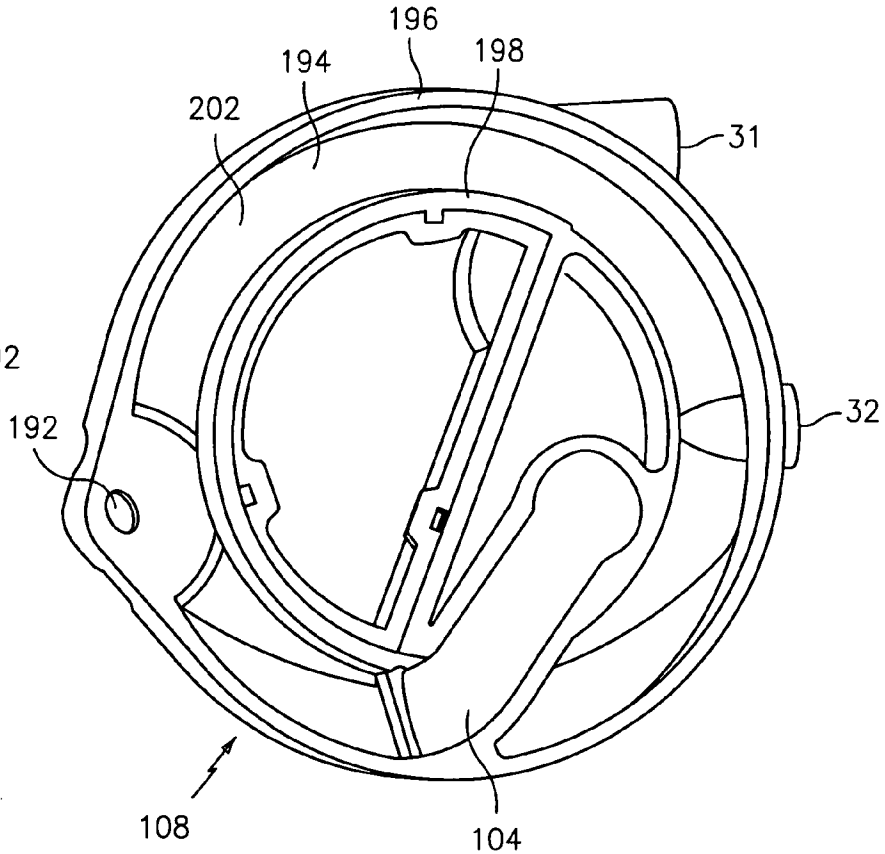
FIG. 8 is a cross-section view of a portion of the upper tank disposed above the cross section of FIG. 7 illustrating that the spiral channel is a closed spiral channel in accordance with an exemplary embodiment.
Figure 7:
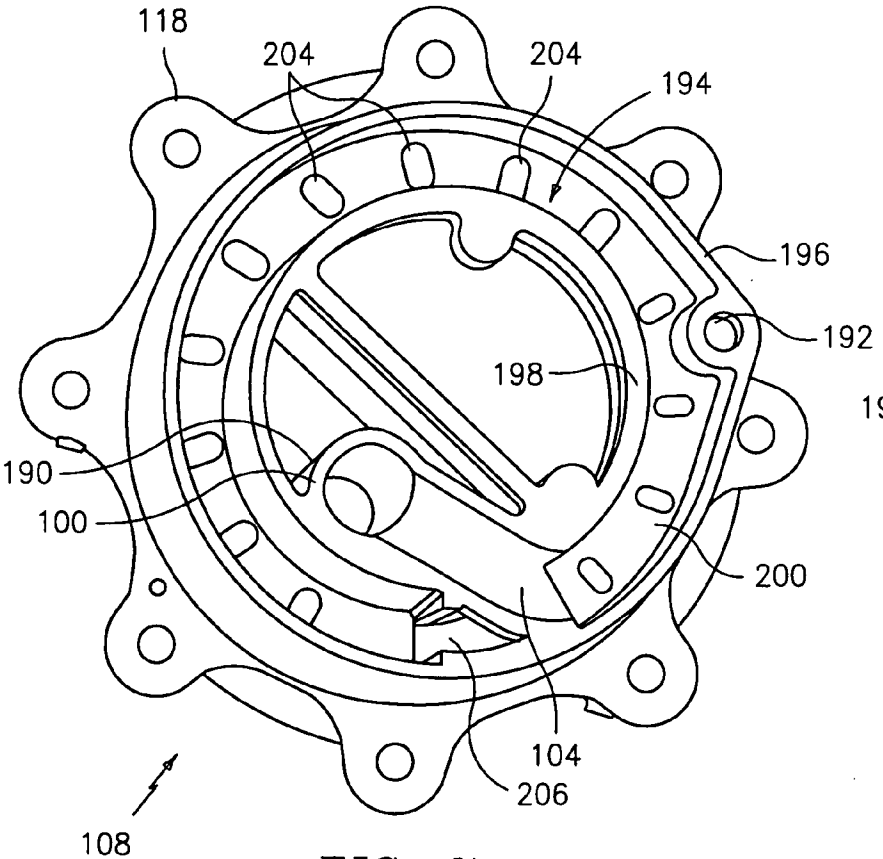
FIG. 7 is a cross-section view of an upper tank of the oil tank assembly of FIG. 2 illustrating a spiral channel configured therein in accordance with an exemplary embodiment.

Referring now to FIGS. 7 and 8, FIG. 7 illustrates a cross section of upper tank 108 through second end 104 of return tube 100, while FIG. 8 illustrates a cross section portion of upper tank 108 disposed above the cross section of FIG. 7. Upper tank 108 includes an upper portion 190 of integral return tube 100 cast therein to align and mate with a lower portion 176 of return tube 100 cast with lower tank 106. Furthermore, an upper tank 108 includes an upper portion 192 of dipstick tube 180 cast therein to align with a lower portion 191 of tube 180 cast with lower tank 106 (FIG. 6).

Second end 104 of return tube 100 directs oil into a spiral channel 194 configured in upper tank 108. Spiral channel 194 is defined by first and second opposing walls 196 and 198 having a spiral floor member 200 defined by opposing edges attached to first and second walls 196 and 198. Spiral floor member 200 is substantially normal to each of the first and second walls 196, 198. FIG. 8 illustrates a cross section portion of upper tank 108 disposed above the cross section portion thereof shown in FIG. 7. More specifically, FIG. 8 illustrates that spiral channel 194 is a closed channel via a spiral ceiling member 202 defined by opposing edges attached to first and second walls 196 and 198. Spiral ceiling member 202 is substantially parallel with spiral floor member 200.

First wall 196 defines upper tank 108 while second wall 198 is substantially defined by an inner cylindrical wall substantially concentric with first wall 196. Spiral floor member 200 spirals down toward lower tank 106 in an annulus defined between first and second walls 196 and 198, respectively. Spiral floor member 200 is further defined with apertures 204 formed along a length thereof to further deaerate oil and allow deaerated oil to fall therethrough back to lower tank 106 via opening 182.

In operation, scavenge pump 27 pumps oil through return hose 103 to second fitting 152 in fluid communication with first end 102 of return tube 100. Return tube 100 flows aerated oil up to upper tank 108 and out end 104 into spiral channel 194. As aerated oil is sprayed tangentially against the inside surface of wall 196, some of the entrained air is thereby separated from the oil by centrifugal force due to the rotating movement of the oil during passage of the oil along the inside surface of the cylindrical wall 196 down spiral channel 194 and out through an outlet of the deaerator generally indicated at 206 and out apertures 202 as oil flows down spiral channel 194. As described above, outlet 31 allows separated air to flow from upper tank 108 to crankcase 12 via tube 50 (FIG. 1).

The above-described dry sump lubrication system provides an oil tank assembly that eliminates an external oil return hose routed to the top of the oil tank assembly. Instead, the external oil return hose is mounted to a bottom portion of the oil tank assembly and feeds oil to a top portion thereof via an internal return tube. In this manner, both of the external oil feed and return hoses may be mounted in parallel at a bottom portion of the tank assembly where it is easier to package and assemble. Furthermore, ease of assembly and underhood packaging make it possible to assemble a dry sump lubrication system in a vehicle on a same assembly line as a non-dry sump lubrication system, thus saving capital and minimizing assembly complexity.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

What is claimed is:

1. A method for connecting a return hose and a feed hose to a same end of an tank assembly for a dry sump lubrication system for an internal combustion engine, the method comprising:

configuring a tank having a first tank portion and a second tank portion;

disposing an interface assembly at said first tank portion, said interface assembly configured to operably deliver and receive a lubricant to and from the engine; and configuring a return tube having a first end in fluid communication with an opposite second end, said first end configured to receive said lubricant from the engine at said interface assembly, said second end in fluid communication with said second tank portion.

2. The method of claim 1 further comprising:

disposing an air separating means at said second tank portion for separating entrained air from oil pumped from the engine by a scavenging pump means; and connecting said second tank portion to said scavenging pump means to receive said lubricant therefrom via the return hose connected to said first end of said return tube at said interface assembly located at said first tank portion.

3. The method of claim 2 further comprising:

configuring said first tank portion as a storage tank for deaerated lubricant from said air separating means.

4. The method of claim 3 further comprising;

configuring said interface assembly to include a first fitting and a second fitting each disposed at first tank portion, said first fitting configured to operably couple with the return hose and said second fitting configured to operably couple with the feed hose, wherein the feed hose is in fluid communication with deaerated oil in said first tank portion.

5. A tank assembly for a dry sump lubrication system for an internal combustion engine comprising:

a tank having a first tank portion and a second tank portion, said first and second tank portions vertically arranged with respect to one another;

an interface assembly disposed at said first tank portion, said interface assembly configured to operably deliver and receive a lubricant to and from the engine; and a return tube having a first end in fluid communication with an opposite second end, said first end in fluid communication with said lubricant from the engine via said interface assembly, said second end in fluid communication with said second tank portion.

6. The tank assembly of claim 5, wherein said interface assembly includes a fitting assembly configured to allow both a return hose and a feed hose to be operably connected from one of an under side and a top side of the engine.

7. The tank assembly of claim 6, wherein said first tank portion is a lower tank portion and said second tank portion is an upper tank portion above said lower tank portion.

8. The tank assembly of claim 6, wherein said first tank portion is an upper tank portion and said second tank portion is a lower tank portion below said upper tank portion.

9. The tank assembly of claim 8, wherein said interface assembly is disposed at said lower tank portion, said first end is configured to receive said lubricant from the engine at said interface assembly, and said second end is in fluid communication with said upper tank portion.

10. The tank assembly of claim 9, wherein said interface assembly includes a fitting assembly located on a bottom portion of said lower tank portion allowing both a return hose and a feed hose to be connected from an underside of the engine.

11. The tank assembly of claim 9, wherein the said interface assembly includes separate fittings located on a bottom portion of said lower tank portion eliminating a need to access said upper tank portion for connection of a return hose.

12. The tank assembly of claim 9, wherein said lower and upper tank portions and said return tube comprise separable sections which are secured together by fastening means to form a unitary assembly to form a unitary assembly and a fluid tight seal between said lower and upper tank portions.

13. The tank assembly of claim 9, wherein said upper tank portion includes at least one of a filler cap and a dip stick extending therefrom.

14. The tank assembly of claim 9, wherein said lower tank portion includes at least one of a lubricant temperature sensor connector and a mounting flange extending therefrom.

15. The tank assembly of claim 9, wherein said lower tank portion includes a baffle plate disposed in an intermediate portion of said lower tank portion, said baffle plate configured to restrict flow of oil past said baffle plate.

16. The tank assembly of claim 9, wherein said interface assembly includes a first fitting and a second fitting each extending from said lower tank portion, said first fitting configured to operably couple with a return hose to receive said lubricant from the engine and said second fitting configured to operably couple with a feed hose to deliver said lubricant to the engine.

17. The tank assembly of claim 9, wherein said return tube is integrated with said upper and lower tank portions and substantially internal to at least said upper tank portion.

18. The tank assembly of claim 9, wherein said return tube is cast with said upper and lower tank portions.

19. The tank assembly of claim 9, wherein said return tube allows a scavenging pump means to feed said lubricant to a bottom portion of said lower tank portion and up to said upper tank portion via said return tube where said lubricant is deaerated and said deaerated lubricant is allowed to return to a storage portion in said lower tank portion.

20. The tank assembly of claim 19, wherein said storage portion is in fluid communication with a feed hose via said interface assembly, said feed hose configured to deliver said lubricant to the engine.

21. The tank assembly of claim 9, wherein said lower tank portion and said upper tank portion each having a portion of said return tube associated therewith comprise separable sections which are secured together by fastening means to form a unitary assembly and a fluid tight seal between said lower and upper tank portions and between each said portion of said return tube.

22. The tank assembly of claim 21, wherein said separable sections of said upper and lower tank portions include a gasket therebetween.

23. The tank assembly of claim 9, wherein said upper tank portion includes an air separating means for separating entrained air from said lubricant pumped from the engine by a scavenging pump means and connected to said scavenging pump means to receive oil therefrom via a return hose connected to said first end of said return tube at said interface assembly located at a bottom portion of said lower tank portion.

24. The tank assembly of claim 23, wherein said lower tank portion is a storage tank for deaerated lubricant from said air separating means.

25. The tank assembly of claim 23, wherein said air separating means includes a spiral channel configured in said upper tank portion, said spiral channel having a first end in fluid communication with said second end of said return tube and a second end open to allow deaerated oil to exit therefrom and flow to said lower tank portion.

26. The tank assembly of claim 25, wherein said spiral channel is further defined with a plurality of apertures along a length thereof to further deaerate lubricant and allow a portion of said deaerated lubricant to exit therefrom and flow to said lower tank portion.

* * * * *